US006174212B1

(12) United States Patent
Chang

(10) Patent No.: US 6,174,212 B1
(45) Date of Patent: Jan. 16, 2001

(54) WATER SKI BOOT WITH TWO-PIECE UPPER TO FACILITATE INSERTION OF A SKIER'S FOOT THEREINTO

(76) Inventor: San-Tsai Chang, 11th Fl., No. 78, Cheng-Kung Rd., Sanchung City, Taipei Hsien (TW)

( * ) Notice: Under 35 U.S.C. 154(b), the term of this patent shall be extended for 0 days.

(21) Appl. No.: 09/400,743

(22) Filed: Sep. 21, 1999

(51) Int. Cl.[7] ..... B63B 35/85

(52) U.S. Cl. ..... 441/70; 280/607

(58) Field of Search ..... 441/65, 68, 69, 441/70; 280/11, 3, 611, 619, 603; 36/114, 117, 119, 121

(56) References Cited

U.S. PATENT DOCUMENTS 5,624,291 * 4/1997 McClaskey ..... 441/70
5,947,781 * 9/1999 VonWald et al. ..... 441/70

* cited by examiner

*Primary Examiner*—Jesus D. Sotelo
(74) *Attorney, Agent, or Firm*—Christensen O'Connor; Johnson Kindness PLLC

(57) ABSTRACT

A water ski boot includes a sole mounted on an anchoring plate with fore and aft parts spaced from each other in a longitudinal direction. An upper includes a molded instep part of a flexible material disposed on a toe portion of the sole, and a molded ankle part disposed on a heel portion of the sole and spaced from the instep part along the longitudinal direction.

1 Claim, 6 Drawing Sheets

WATER SKI BOOT WITH TWO-PIECE UPPER TO FACILITATE INSERTION OF A SKIER'S FOOT THEREINTO

FIELD OF THE INVENTION

The invention relates to a boot, more particularly to a water ski boot which is adapted to be mounted on a water ski board and which has an upper of a two-piece structure to facilitate insertion of a foot thereinto.

BACKGROUND OF THE INVENTION

Water skiing is a popular sport. A conventional water ski boot holds a skier's foot in position on a ski board, and the water ski boot is generally built onto the ski board non-detachably. To provide snug fitting to the skier's foot, the conventional water ski boot is generally made of soft and flexible rubber.

Referring to FIGS. 1 and 2, a conventional water ski boot is shown and is adapted to be mounted securely on a water ski board. The conventional water ski boot includes an anchoring plate 1 of a rigid material, a sole 10 disposed on the anchoring plate 1, an upper 21 of a one-piece structure and made from a flexible material and mounted on the anchoring plate 1, and left and right flap members 20 mounted on lateral anchoring portions of the anchoring plate 1 by means of two press rods 11. Fore and aft binding strap members 30,31 are also retained on the anchoring plate 1 by the press rods 11, where tightening of the press rods 11 provides snug fitting and stability to the skier's ankle and lower leg on the conventional water ski boot.

A disadvantage that results from the use of the conventional water ski boot resides in that, when placing the skier's foot into the upper 21, the fore and aft sections of the upper 21 have to be pulled apart from each other, only then can the skier's foot be inserted into the upper 21. This inconveniences the skier.

SUMMARY OF THE INVENTION

Therefore, the object of this invention is to provide a water ski boot which is adapted to be mounted on a water ski board and which has an upper of a two-piece structure to facilitate insertion of a skier's foot thereinto.

Accordingly, a water ski boot of the present invention is adapted to be mounted on a water ski board by an anchoring plate which has upper and lower major walls opposite to each other in a first transverse direction. The upper major wall is provided with fore and aft parts opposite to each other in a longitudinal direction. Each of the fore and aft parts has left and right lateral anchoring portions opposite to each other in a second transverse direction which is both transverse to the first transverse direction and the longitudinal direction. The water ski boot includes a sole, an upper, left and right fore flap members, a first strap member, left and right aft flap members, and a second strap member. The sole has toe and heel portions adapted to be disposed on the fore and aft parts respectively and opposite to each other in the longitudinal direction. The upper includes a molded instep part made of a flexible material and having an instep contacting portion with left and right fore clamped edges opposite to each other in the second transverse direction and adapted to engage with the corresponding left and right lateral anchoring portions of the fore part so as to secure the toe portion on the fore part. A front adjusting half extends from the instep contacting portion uprightly and rearwardly to form a contour adapted to be wrapped around a fore part of a user's lower leg. A molded ankle part is spaced apart from the molded instep part in the longitudinal direction, and has an ankle contacting portion with left and right aft clamped edges adapted to engage with the corresponding left and right lateral anchoring portions of the aft part so as to secure the heel portion of the sole on the aft part of the anchoring plate. A rear adjusting half extends from the ankle contacting portion upwardly and forwardly so as to form a contour adapted to be wrapped around a rear part of the user's lower leg. The left and right fore flap members are made of a material more rigid than the flexible material, and respectively have left and right fore clamping edges to clamp the left and right fore clamped edges respectively down on the left and right lateral anchoring portions of the fore part. Left and right strapped ends respectively extend from the left and right clamping edges uprightly and toward each other in the second transverse direction. The first strap member is disposed to tighten the left strapped end to the right strapped end along the second transverse direction to depress the instep contacting portion so as to render the instep contacting portion to fit snugly the user's instep. The left and right aft flap members are made of a material more rigid than the flexible material, and respectively have left and right aft clamping edges to clamp the left and right aft clamped edges respectively down on the left and right lateral anchoring portions of the aft part, and left and right strapped ends respectively extending from the left and right clamping edges upwardly and towards each other in the second transverse direction. A rear adjusting half pushing portion interconnects and is integrally formed with the left and right aft strapped ends so as to surround the front and rear adjusting halves in a surrounded state. The rear adjusting half pushing portion is spaced apart from the heel portion in the first transverse direction such that when the front and rear adjusting halves are in the surrounded state, the ankle contacting portion is exposed rearwardly and outwardly of the rear adjusting half pushing portion. The second strap member is disposed to tighten the left aft strapped end to the right aft strapped end when the front and rear adjusting halves are in the surrounded state so as to bring the front and rear adjusting halves to move towards each other, thereby rendering the front and rear adjusting halves to fit snugly and respectively the fore and rear parts of the user's leg.

BRIEF DESCRIPTION OF THE DRAWINGS

Other features and advantages of this invention will become more apparent in the following detailed description of the preferred embodiment of this invention, with reference to the accompanying drawings, in which.

DETAILED DESCRIPTION OF THE PREFERRED EMBODIMENT

Figure 1:
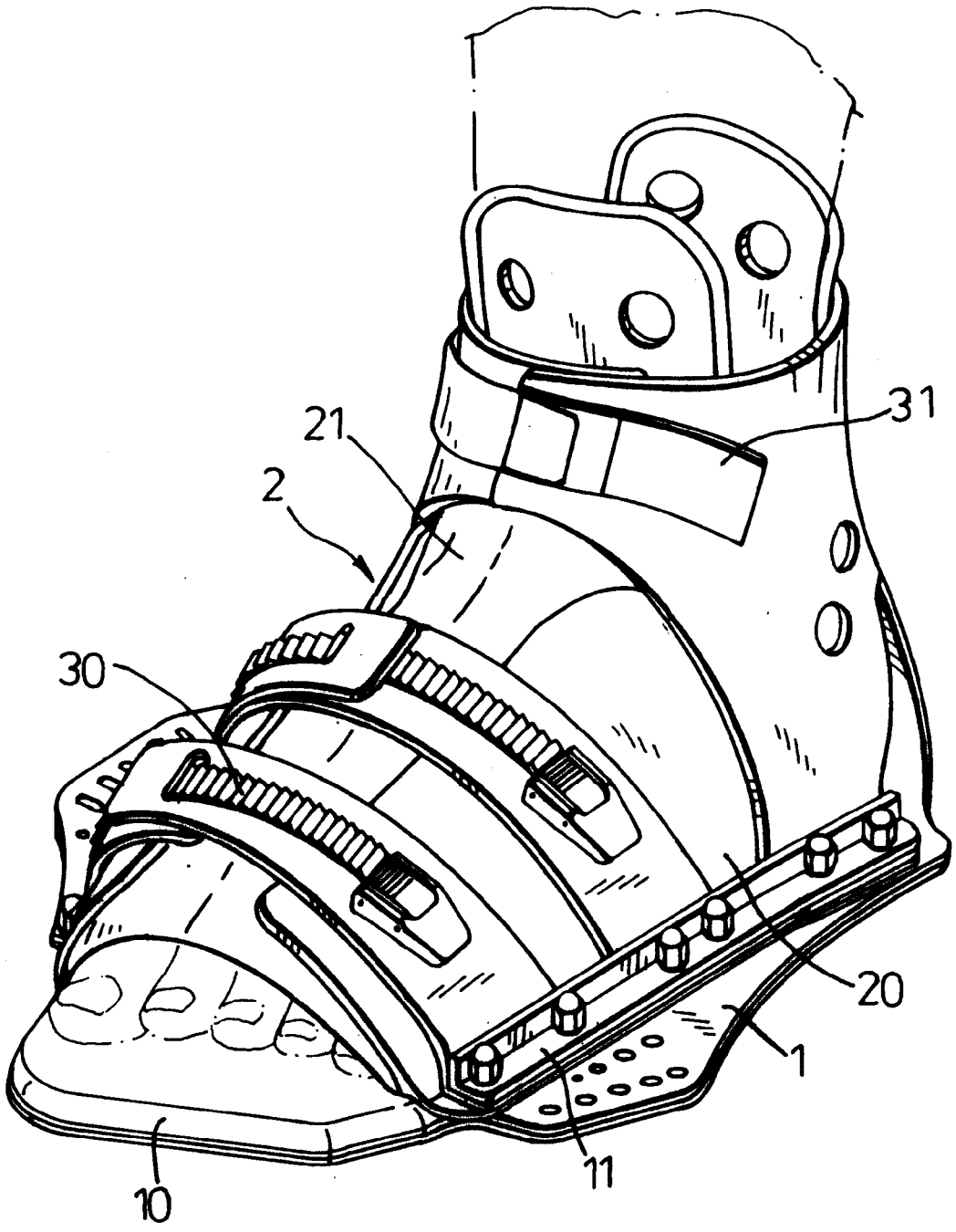
FIG. 1 PRIOR ART
FIG. 1 is a perspective view of a conventional water ski boot adapted to be mounted securely on a ski board.
Figure 2:
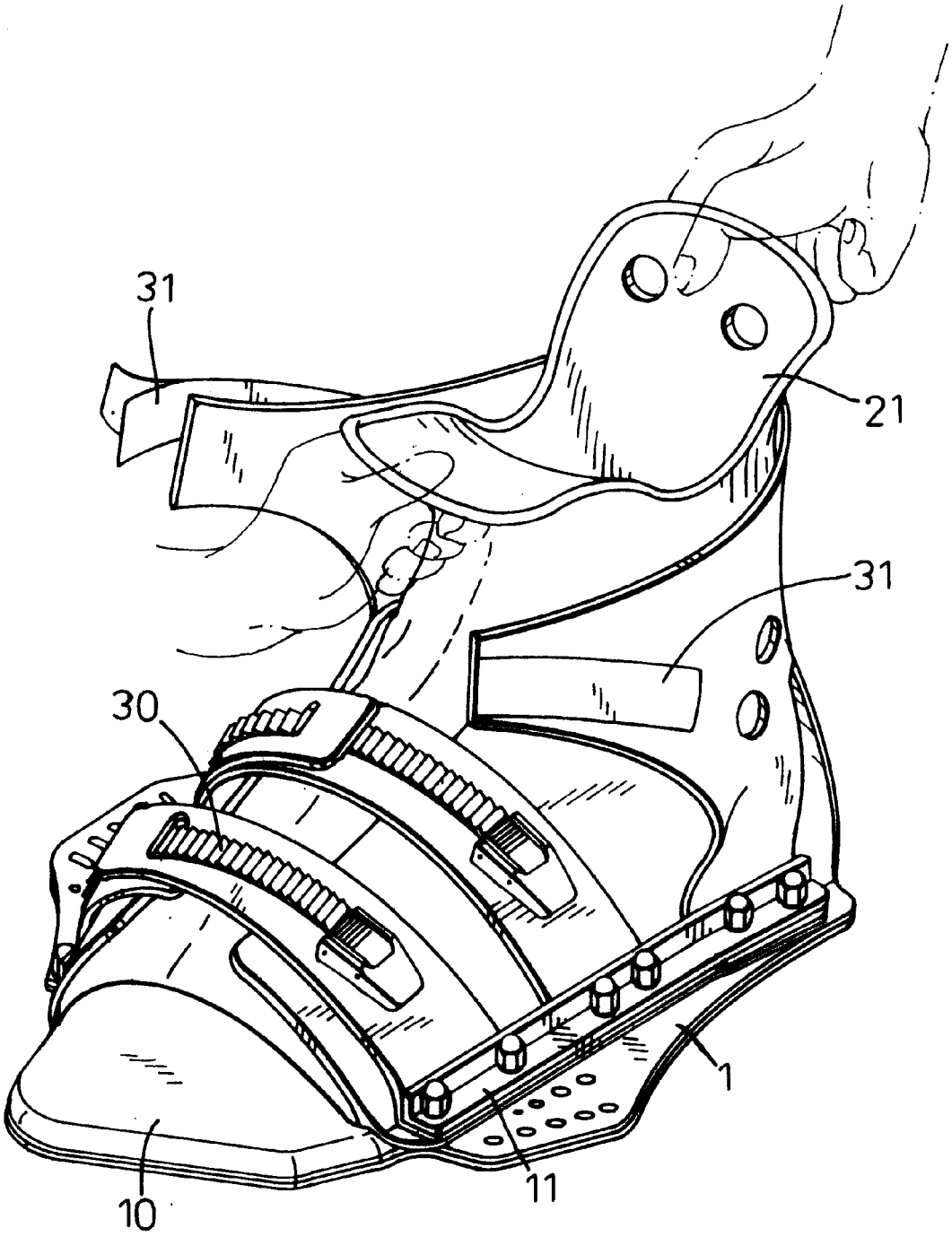
FIG.2 PRIOR ART
FIG. 2 shows how an upper of the conventional water ski boot is pulled by two hands of a skier so as to facilitate insertion of the skier's foot thereinto.
Figure 3:
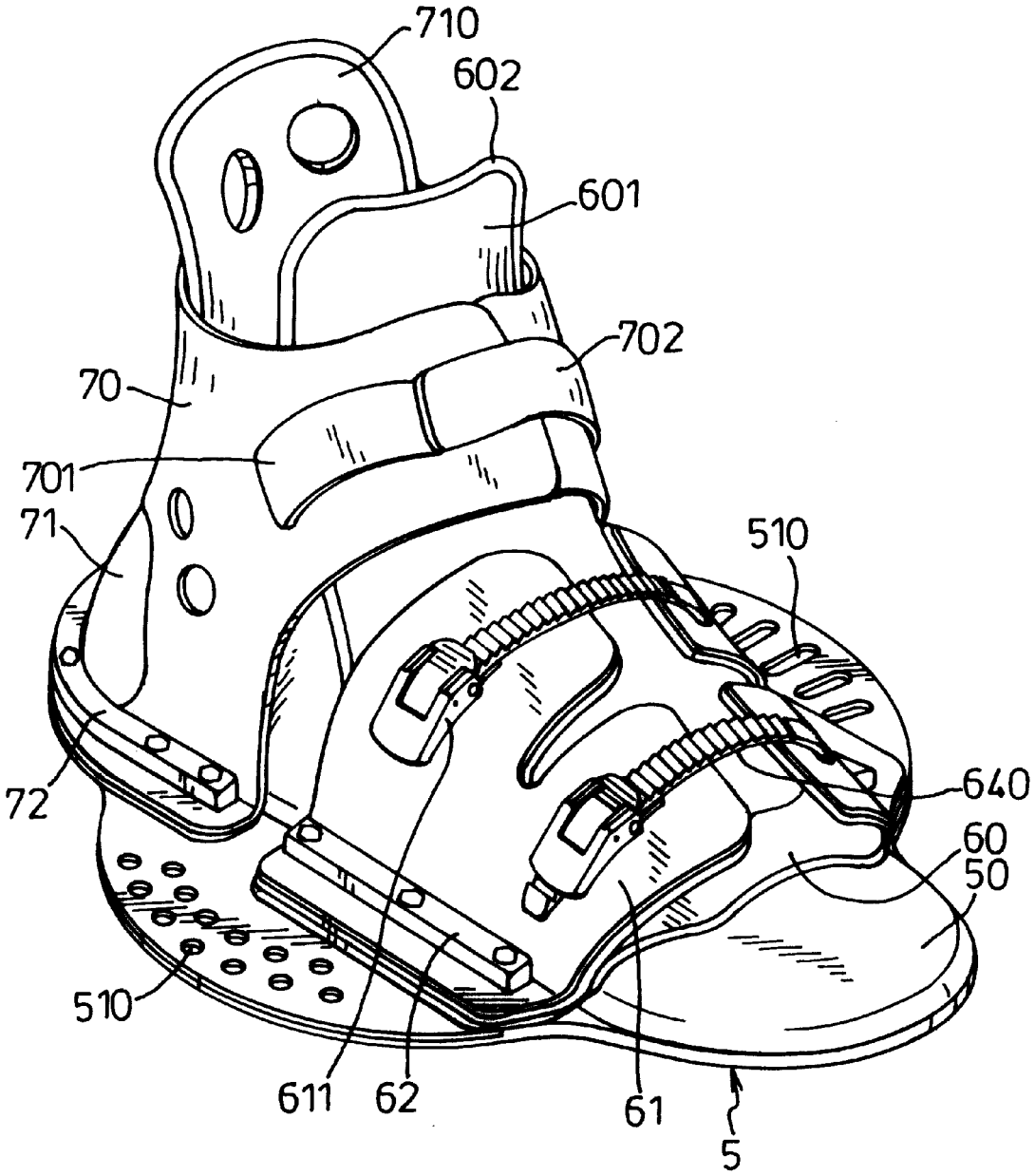
FIG. 3 is a perspective view of the preferred embodiment of a water ski boot of the present invention, the preferred embodiment being adapted to be mounted securely on a water ski board.
Figure 4:
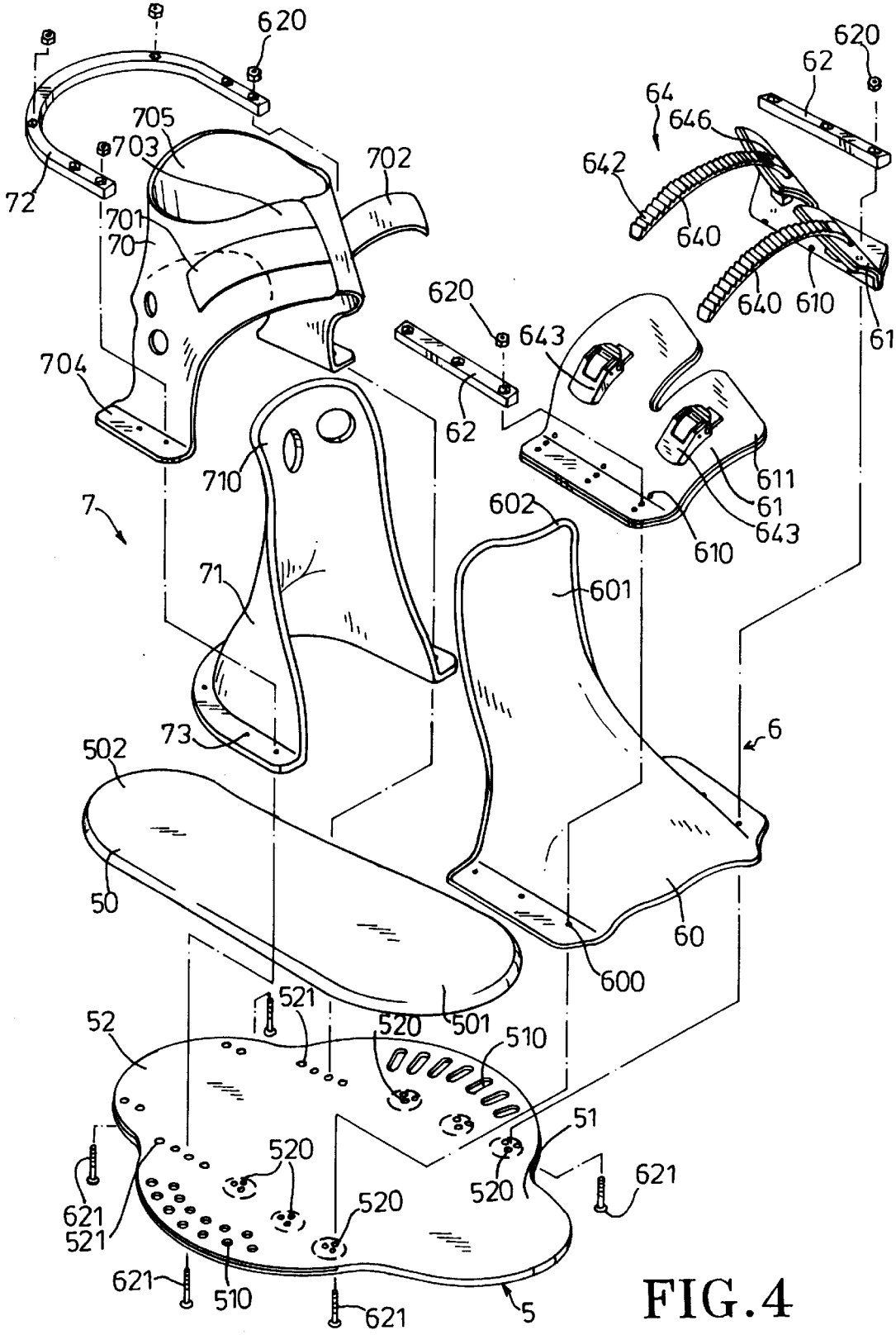
FIG. 4 is an exploded view of the preferred embodiment.
Figure 5:
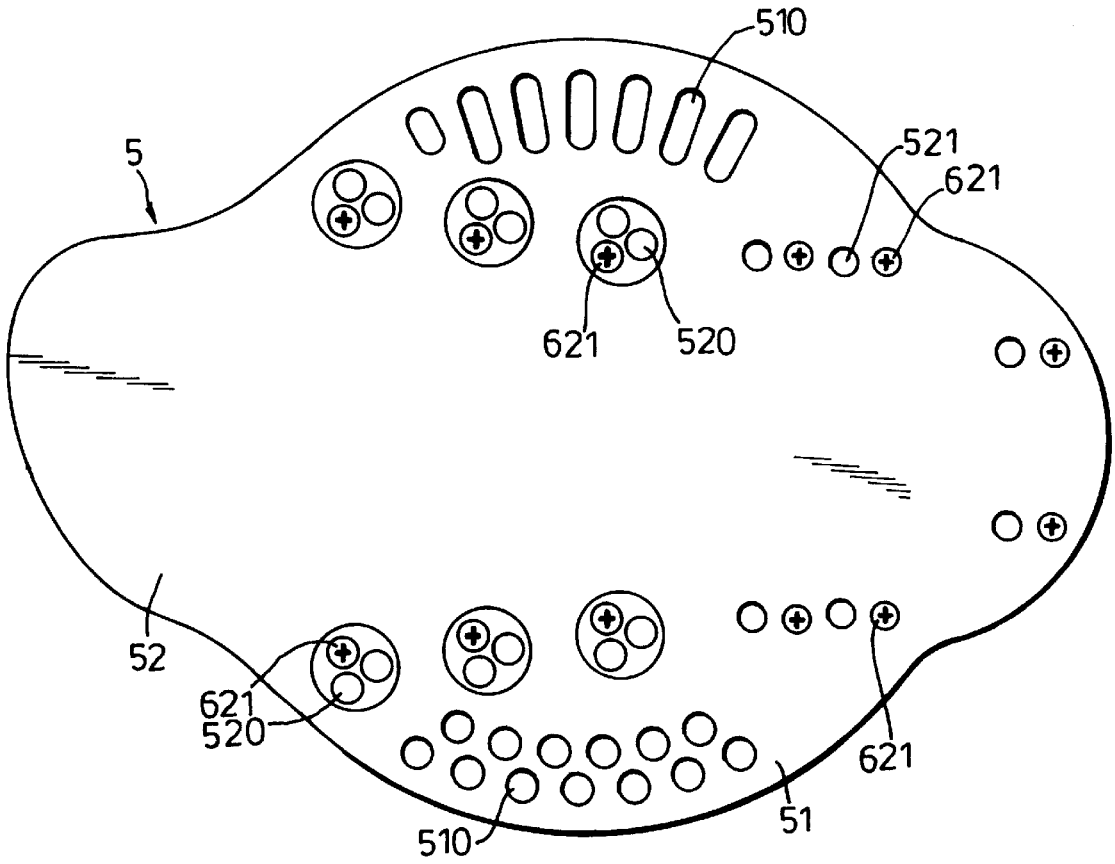
FIG. 5 is a top planar view of an anchoring plate employed in the preferred embodiment.

Referring to FIGS. 3, 4 and 5, the preferred embodiment of a water ski boot according to the present invention is shown to include an anchoring plate 5, a sole 50, an upper, left and right fore flap members 61, a first strap member 64, left and right aft flap members 703, and a second strap member 702.

As illustrated, the anchoring plate 5 is preferably made of a rigid material, and has upper and lower major walls opposite to each other in a first transverse direction. The upper major wall is provided with fore and aft parts 51,52 opposite to each other in a longitudinal direction. Each of the fore and aft parts 51,52 has left and right lateral anchoring portions opposite to each other in a second transverse direction which is both transverse to the first transverse direction and the longitudinal direction.

The sole 50 has toe and heel portions 501,502 adapted to be disposed on the fore and aft parts 51,52 respectively and opposite to each other in the longitudinal direction.

Figure 7:
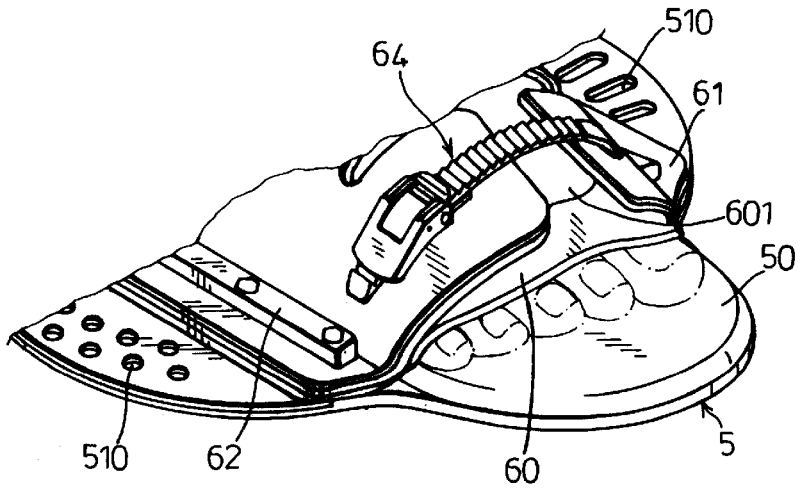
FIG. 7 is a fragmentary perspective view of the preferred embodiment, illustrating how the skier's foot is inserted thereinto.

The upper includes a molded instep part 6 and a molded ankle part 7. The instep part 6 is made from a flexible material, such as rubber, and includes an instep contacting portion 60 with left and right fore clamped edges 600 opposite to each other in the second transverse direction and adapted to engage with the corresponding left and right lateral anchoring portions of the fore part 51 so as to secure the toe portion 501 on the fore part 51. A front adjusting half 601 extends from the instep contacting portion 60 uprightly and rearwardly to form a contour adapted to be wrapped around a fore part of a skier's lower leg, as best shown in FIG. 7. The molded ankle part 7 is spaced apart from the molded instep part 6 in the longitudinal direction, and has an ankle contacting portion 71 with left and right aft clamped edges 73 adapted to engage with the corresponding left and right lateral anchoring portions of the aft part 52 so as to secure the heel portion 502 of the sole 50 on the aft part 52 of the anchoring plate 5. A rear adjusting half 710 extends from the ankle contacting portion 71 upwardly and forwardly so as to form a contour adapted to be wrapped around a rear part of the skier's leg.

The left and right fore flap members 61 are made from a material more rigid than the flexible material, and respectively have left and right fore clamping edges 610 to clamp the left and right fore clamped edges 600 respectively down on the left and right lateral anchoring portions of the fore part 51. Left and right strapped ends 611 respectively extend from the left and right clamping edges 610 uprightly and toward each other in the second transverse direction.

The first strap member 64 is disposed to tighten the left strapped end 611 to the right strapped end 611 along the second transverse direction to depress the instep contacting portion 60 so as to render the instep contacting portion 60 to fit snugly the user's instep. Preferably, the first strap member 64 includes two fastener strap portions 640 having first end portions 646 fixed on the left fore flap member 61 and second end portions 642 formed with engaging teeth thereon, and two buckles 643 fixed on the right fore flap member 61 in alignment with and for fastening the second end portions 642 so as to depress the instep contacting portion 60 relative to the skier's instep.

The left and right aft flap members 70 are made of a material more rigid than the flexible material and respectively have left and right aft clamping edges 704 to clamp the left and right aft clamped edges 73 respectively down on the left and right lateral anchoring portions of the aft part 52, and left and right strapped ends 703 respectively extending from the left and right clamping edges 704 upwardly and towards each other in the second transverse direction A rear adjusting half pushing portion 705 interconnects and is integrally formed with the left and right aft strapped ends 703 so as to encircle the front and rear adjusting halves 601,710 in a surrounded state. The rear adjusting half pushing portion 705 is spaced apart from the heel portion 502 in the first transverse direction such that when the front and rear adjusting halves 601,710 are in the surrounded state, the ankle contacting portion 71 is exposed rearwardly and outwardly of the rear adjusting half pushing portion 705.

The second strap member 702 is disposed to tighten the left aft strapped end 703 to the right aft strapped end 703 when the front and rear adjusting halves 601,710 are in the surrounded state so as to bring the front and rear adjusting halves 601,710 to move towards each other, thereby rendering the front and rear adjusting halves 601,710 to fit snugly and respectively the fore and rear parts of the user's leg. The second strap member 702 preferably includes two Velcro hook-and-looped strap portions 701, each provided on a respective one of the left and right aft strapped ends 703.

In the preferred embodiment, two elongate fore press rods 62 are disposed on the left and right fore clamping edges 610 so as to compress the clamped edges 600 of the instep contacting portion 60. A C-shaped aft press rim 72 is disposed around the left and right aft clamping edges 704 so as to compress the left and right aft clamped edges 73 of the ankle contacting portion 71. A plurality of screws 621 and nuts 620 are employed for mounting of the press rods 62 and the press rim 72 on the anchoring portion of the anchoring plate 5.

Note that the fore part 51 of the anchoring plate 5 is formed with three sets of mounting holes 520 which permit adjustable mounting of the molded instep part 6 along the second transverse direction in order to conform with the width of the skier's foot. The aft part 52 of the anchoring plate 5 is formed with two rows of mounting holes 521 in the longitudinal direction such that a distance between the ankle part 7 and the instep part 6 can be varied to conform with a length of the skier's foot in the longitudinal direction. The left and right lateral portions of the anchoring plate 5 are formed with a plurality of elongate slots 510 and circular holes 510 for mounting on a ski board (not shown). The anchoring plate 5 is thus adjustable on the ski board along the second transverse direction and the longitudinal direction, as best shown in FIG. 5.

Figure 6:
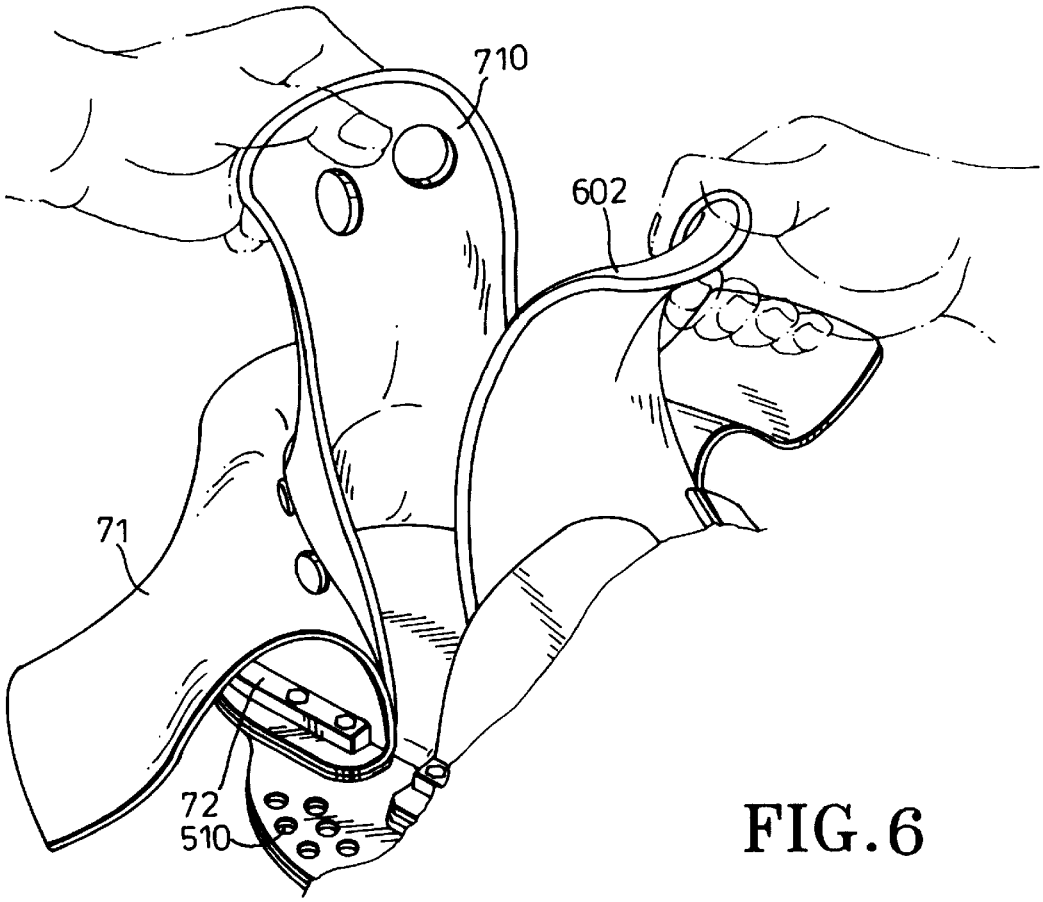
FIG. 6 illustrates how an upper of the preferred embodiment is pulled by a skier's hands so as to facilitate insertion of the skier foot thereinto.

As best shown in FIG. 6, when inserting a skier's foot into the water ski boot of the present invention, the skier only needs to pull the instep part 6 and the ankle part 7 away from one another so as to permit ease insertion of the skier's foot into the upper. The skier's foot is further secured by the first and second strap members 64,702 so as to provide stability and maximum control of the skier's body on the ski boot.

With this invention thus explained, it is apparent that numerous modifications and variations can be made without departing from the scope and spirit of this invention. It is therefore intended that this invention be limited only as indicated in the appended claims.

I claim:

1. A water ski boot adapted to be mounted on a water ski by an anchoring plate which has upper and lower major walls opposite to each other in a first transverse direction, the upper major wall provided with fore and aft parts opposite to each other in a longitudinal direction, each of the fore and aft parts having left and right lateral anchoring portions opposite to each other in a second transverse direction which is both transverse to the first transverse direction and the longitudinal direction, the water ski boot comprising:

a sole with toe and heel portions adapted to be disposed on the fore and aft parts respectively and opposite to each other in the longitudinal direction;

an upper including a molded instep part made of a flexible material and having an instep contacting portion with left and right fore clamped edges opposite to each other in the second transverse direction and adapted to engage with the corresponding left and right lateral anchoring portions of the fore part so as to secure said toe portion on the fore part, and a front adjusting half extending from said instep contacting portion uprightly and rearwardly to form a contour adapted to be wrapped around a fore part of a user's lower leg; and a molded ankle part space apart from said molded instep part in the longitudinal direction and having an ankle contacting portion with left and right aft clamped edges adapted to engage with the corresponding left and right lateral anchoring portions of the aft part so as to secure said heel portion of said sole on the aft part of the anchoring plate, and a rear adjusting half extending from said ankle contacting portion upwardly and forwardly so as to form a contour adapted to be wrapped around a rear part of the user's lower leg;

left and right fore flap members made of a material more rigid than said flexible material and respectively having left and right fore clamping edges to clamp said left and right fore clamped edges respectively down on said left and right lateral anchoring portions of the fore part, and left and right strapped ends respectively extending from said left and right clamping edges uprightly and toward each other in said second transverse direction;

a first strap member disposed to tighten said left strapped end to said right strapped end along said second transverse direction to depress said instep contacting portion so as to render said instep contacting portion to fit snugly the user's instep;

left and right aft flap members made of a material more rigid than said flexible material and respectively having left and right aft clamping edges to clamp said left and right aft clamped edges respectively down on said left and right lateral anchoring portions of the aft part, and left and right strapped ends respectively extending from said left and right clamping edges upwardly and towards each other in said second transverse direction;

a rear adjusting half pushing portion interconnecting and integrally formed with said left and right aft strapped ends so as to surround said front and rear adjusting halves in a surrounded state, said rear adjusting half pushing portion being spaced apart from said heel portion in the first transverse direction such that when said front and rear adjusting halves are in said surrounded state, said ankle contacting portion is exposed rearwardly and outwardly of said rear adjusting half pushing portion; and a second strap member disposed to tighten said left aft strapped end to said right aft strapped end when said front and rear adjusting halves are in a surrounded state so as to bring said front and rear adjusting halves to move towards each other thereby rendering said front and rear adjusting halves to fit snugly and respectively the fore and rear parts of the user's leg.

* * * * *